US008371269B2

(12) United States Patent
Wang et al.

(10) Patent No.: US 8,371,269 B2
(45) Date of Patent: Feb. 12, 2013

(54) ELECTRONIC CONTROL COMMON RAIL DME INJECTION SYSTEM

(75) Inventors: Yang Wang, Tianjin (CN); Xiao Zhang, Tianjin (CN); Tao Zhu, Tianjin (CN); Shuaiqing Xu, Tianjin (CN); Qian Xiong, Tianjin (CN); Mingfa Yao, Tianjin (CN); Qingyun Tian, Tianjin (CN); Fang He, Tianjin (CN); Zhong Zhang, Tianjin (CN)

(73) Assignee: Tianjin University, Nankai District, Tianjin (CN)

( * ) Notice: Subject to any disclaimer, the term of this patent is extended or adjusted under 35 U.S.C. 154(b) by 409 days.

(21) Appl. No.: 12/716,119

(22) Filed: Mar. 2, 2010

(65) Prior Publication Data

US 2010/0236527 A1 Sep. 23, 2010

(30) Foreign Application Priority Data

Mar. 20, 2009 (CN) ..... 2009 1 0068197

(51) Int. Cl.
*F02B 3/06* (2006.01)
*F02B 3/08* (2006.01)

(52) U.S. Cl. ..... 123/456; 123/27 GE

(58) Field of Classification Search ..... 123/456, 123/27 GE, 478, 447, 458, 575, 525, 526, 123/DIG. 5; 701/103
See application file for complete search history.

(56) References Cited

U.S. PATENT DOCUMENTS

| | | | | |
|---|---|---|---|---|
| 6,742,479 | B2 * | 6/2004 | Yanagisawa | 123/1 A |
| 2002/0189589 | A1 * | 12/2002 | Kato et al. | 123/458 |
| 2010/0258084 | A1 * | 10/2010 | Lundgren | 123/456 |

* cited by examiner

*Primary Examiner* — Mahmoud Gimie

(57) ABSTRACT

A common rail electronic control injection system which uses a DME or a low-viscosity fuel similar with DME to inject into a combustion engine, includes a fuel container, a common rail tube, a high-pressure tube, an electronic control injector, an electronic control unit, a high-pressure pump, a working medium case, a reversing component, and a pressure convertor, wherein the pressure convertor includes at least two working components, each working component is divided into a fuel chamber and a working medium chamber by an dividing element, the dividing element can freely deform or move between the fuel chamber and the working medium chamber by pressure effect. The invention avoids the sealing and abrasion problem in the plunger matching portions which is caused by the low-viscosity fuel so as to greatly improve the lifetime and reliability of system.

20 Claims, 3 Drawing Sheets

ELECTRONIC CONTROL COMMON RAIL DME INJECTION SYSTEM

BACKGROUND OF THE PRESENT INVENTION

1. Field of Invention

The present invention relates generally to an engine fuel injection system, and more particularly to an electronic control common rail DME injection system.

2. Description of Related Arts

DME is known as a "green substitution fuel for diesel in 21st century", but the DME is a gas at normal temperature and pressure, and has low viscosity, and poor sealing. The above characters cause sealing and abrasion problem in the plunger matching portions in the injection system, which is the difficult problem in application. Besides DME, the other low-viscosity fuels, such as liquefied petroleum gas (LPG), also have same low viscosity to cause the sealing and abrasion problem in the plunger matching portions in the injection system. The US006119664A patent of AVL company disclosed a common rail electronic control injection system using a low-viscosity fuel. The system comprises a high-pressure pump, a common rail tube, an electronic control injector, an electronic control unit, wherein the fuel is pressed to 200-350 bar by the high-pressure pump and is sent into the common rail tube, a two-position three-way solenoid valve is disposed between the common rail tube and the electronic control injector, the electronic control injector begins to inject when the common rail tube is connected with the electronic control injector via the two-position three-way solenoid valve, and the electronic control injector stops injecting when the two-position three-way solenoid valve is connected with a returning tube. The disadvantage of this design is that the sealing and abrasion problem in the plunger matching portions is inevitable because DME is directly pressed by the high-pressure pump.

SUMMARY OF THE PRESENT INVENTION

An object of the present invention is to provide a common rail electronic control injection system, which is capable of avoiding the sealing and abrasion problem in the plunger matching portions of oil pump so as to greatly improve the lifetime and durability of system.

Another object of the present invention is to provide a common rail electronic control injection system, wherein the high-pressure pump is universal in the hydraumatic industry so as to reduce the manufacture cost.

Accordingly, in order to accomplish the above objects, the present invention provides a common rail electronic control injection system, comprising:

a fuel container containing a fuel of DME or other low-viscosity fuel, a common rail tube, a high-pressure tube, an electronic control injector, an electronic control unit, a high-pressure pump, a working medium case containing a working medium, a reversing component for reversing the transport direction of the working medium, and a pressure convertor transferring working medium pressure to the fuel;

wherein the electronic control injector is connected with the common rail tube through the high-pressure tube;

the working medium case, the high-pressure pump, the reversing component and the pressure convertor connect in turn by pipeline;

an inlet of the pressure convertor is communicated with the fuel in the fuel container, an outlet of the pressure convertor is connected with the common rail tube;

the pressure convertor comprises at least two parallel working components, wherein each working component is divided into a fuel chamber and a working medium chamber by a dividing element. The dividing element can freely deform or move between the fuel chamber and the working medium chamber by pressure effect, The number of the working components is preferably two;

the fuel chamber is connected in parallel with an input one-way valve and an output one-way valve, the input one-way valve is connected with an inlet of the fuel chamber, the output one-way valve is connected with an outlet of the fuel chamber;

the working medium chamber is connected with an outlet of the reversing component through a gangway of the working medium chamber and a working medium tube.

As a preferred embodiment, the working medium is diesel oil, engine lubricant or hydraulic oil.

The dividing element is preferably a flexible film. A periphery of flexible film is hermetically fixed on an inner wall of the working component. Further, the flexible film is made of fluorine rubber.

The reversing component is a two-position four-way solenoid valve controlled by the electronic control unit, wherein a pressure inlet of the two-position four-way solenoid valve is connected with an outlet of the high-pressure pump, a liquid returning vent of the two-position four-way solenoid valve is connected with the working medium case.

An relief valve is disposed between the outlet of the high-pressure pump and the pressure inlet of the two-position four-way solenoid valve, wherein the relief valve is controlled by the electronic control unit, a liquid returning vent of the relief valve is connected with the working medium case. In order to further improve control precision of common rail pressure, a pressure sensor is disposed on the common rail tube for measuring fuel pressure within the common rail tube, wherein a signal output of the pressure sensor is connected with the electronic control unit.

In order to reduce the leakage, an electronic control one-way valve is connected between the common rail tube and the output main tube, and is controlled by the electronic control unit, when the electronic control one-way valve is power-on, the electronic control one-way valve is two-way through; when the electronic control one-way valve is power-off, the electronic control one-way valve is one-way through, namely, the liquid or gas in common rail tube can pass through the electronic control one-way valve, while the opposite way is blocked.

With the above project, the pump does not press the low-viscosity fuel directly, so as to avoid leakage and abrasion of the plunger, so as to extend service life of the system. The high-pressure pump is universal in the hydraumatic industry so as to reduce the manufacture cost. Long-time test proves that the common rail electronic control injection system has no irregular abrasion in the plunger matching portions.

These and other objectives, features, and advantages of the present invention will become apparent from the following detailed description, the accompanying drawings, and the appended claims.

BRIEF DESCRIPTION OF THE DRAWINGS

FIG. 2 is a graph of injection rule under different common rail pressure.

FIG. 3 is a graph of injection quantity under different common rail pressure and different drive impulse duration.

FIG. 4 is a graph of preinjection rule by adjusting drive pulse signal, both the preinjection quantity and the space between the mail pulse injections are easily controlled by adjusting the drive impulse duration of the preinjection drive pulse and the space between the main pulses.

FIG. 5 is a photo of spraying according to different injection time in preinjection process.

DETAILED DESCRIPTION OF THE PREFERRED EMBODIMENT

Figure 1:
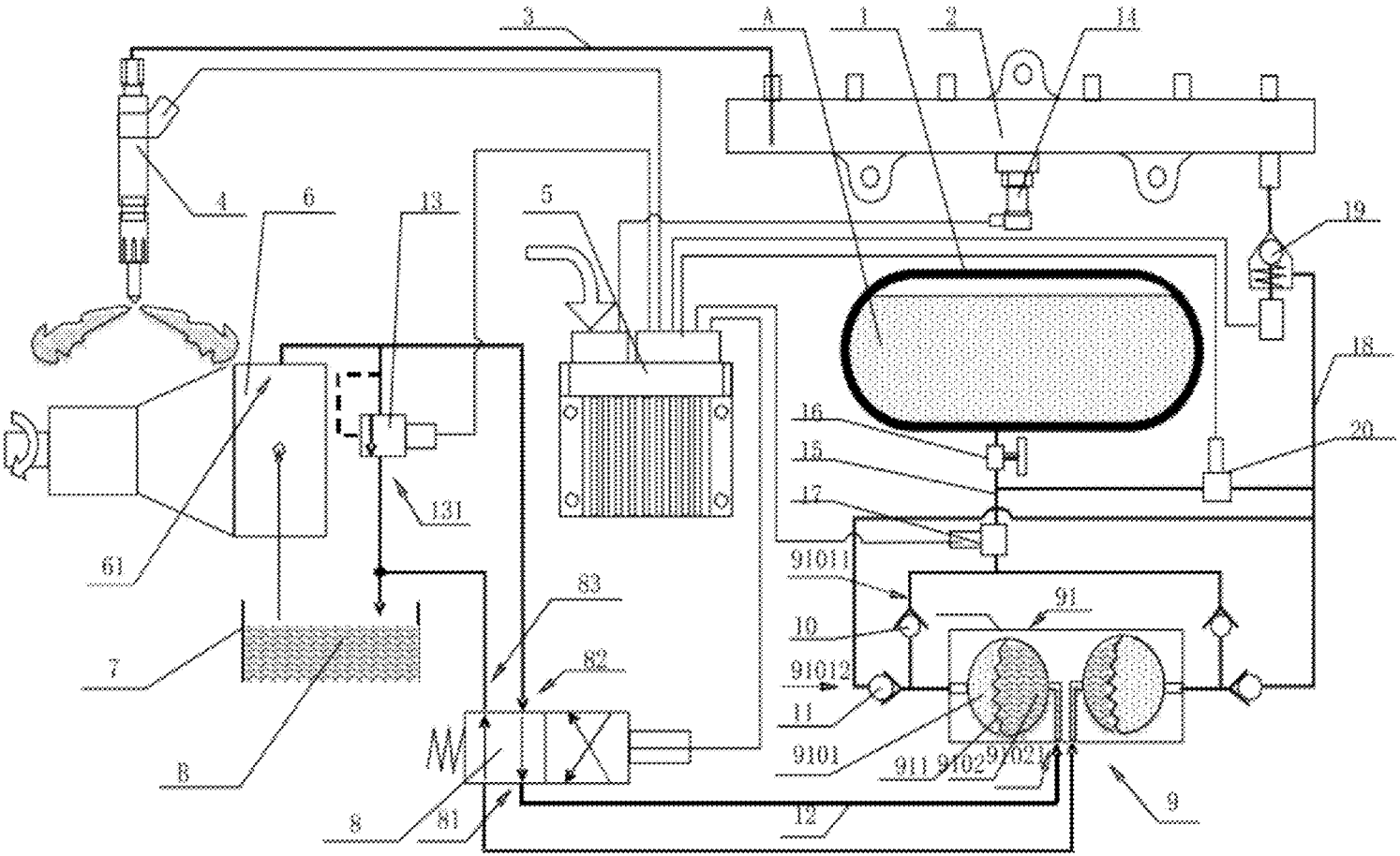
FIG. 1 is a schematic view of a common rail electronic control injection system according to a preferred embodiment of the present invention.
Figure 2:
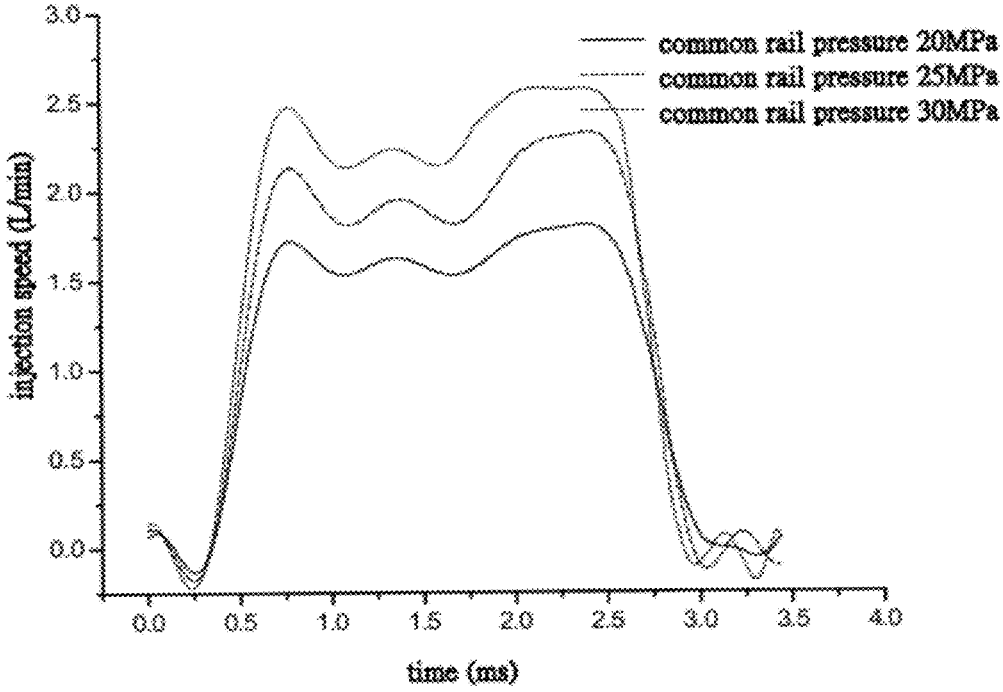
FIG. 2 to FIG. 5 are measure graph and photo according to the injection experiment of the present invention.
Figure 3:
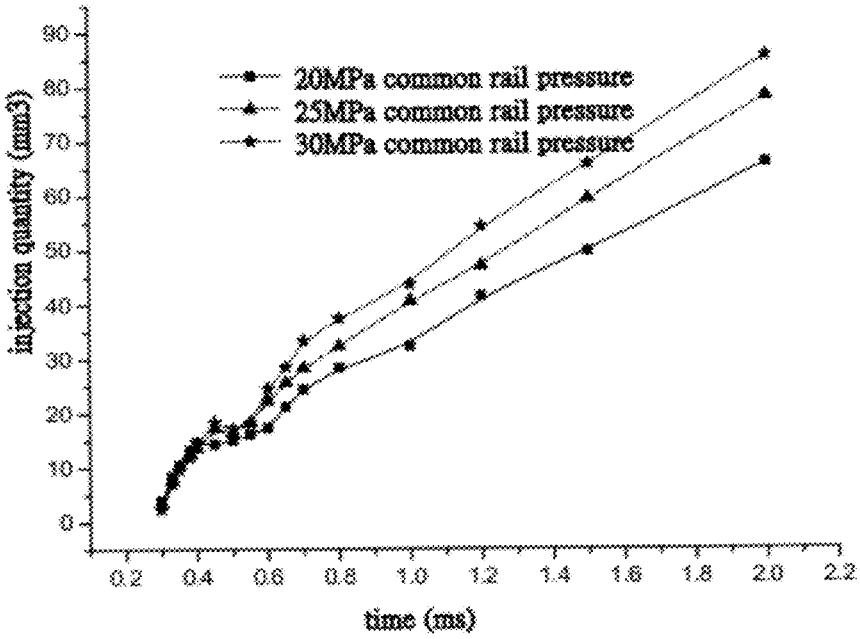
Figure 4:
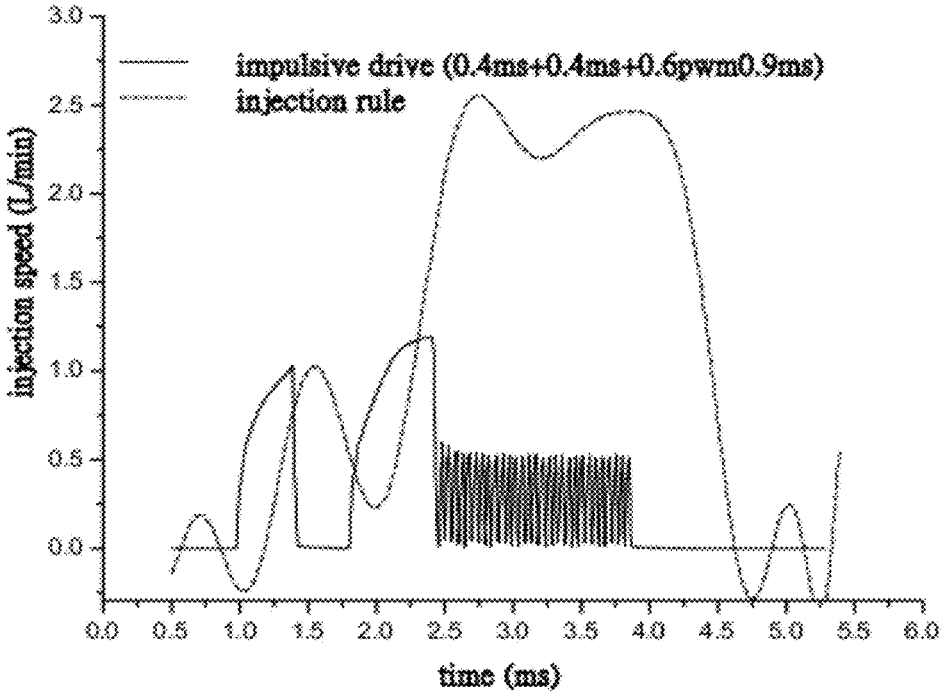
Figure 5:
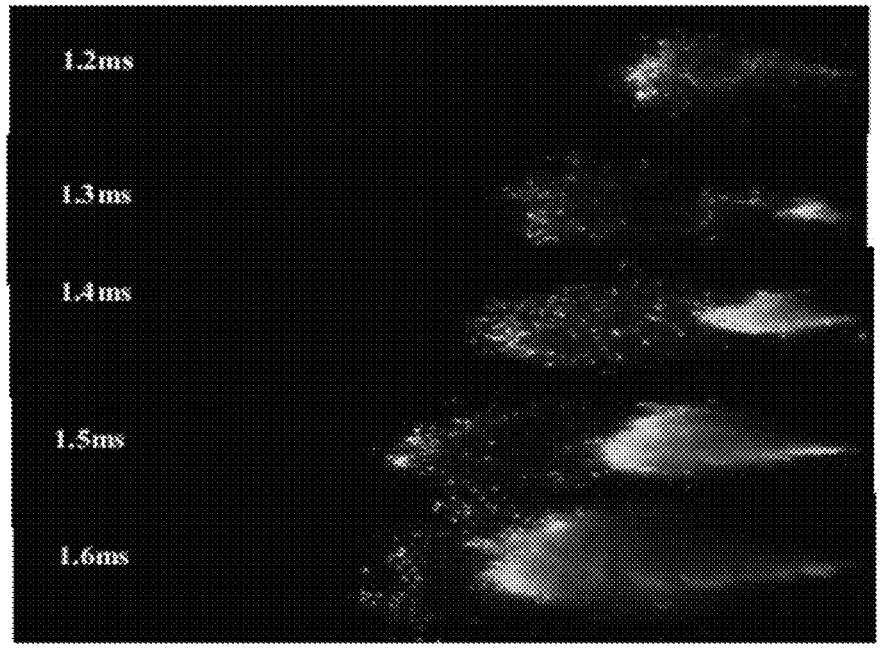

Referring to FIG. 1 of the drawings, a common rail electronic control injection system according to a preferred embodiment of the present invention is illustrated, which comprises a fuel container 1 containing a fuel A which is DME or a low-viscosity fuel similar with DME, a common rail tube 2, a high-pressure tube 3, an electronic control injector 4, an electronic control unit 5, a high-pressure pump 6, a working medium case 7 containing a working medium B, a reversing component 8 for reversing the transport direction of the working medium B, and a pressure convertor 9 transferring working medium B pressure to the fuel A, wherein the electronic control injector 4 is connected with the common rail tube 2 via the high-pressure tube 3; the working medium case 7, the high-pressure pump 6, the reversing component 8 and the pressure convertor 9 connect in turn by pipeline.

The pressure convertor 9 consists of two working components 91, wherein each working component 91 is divided into a fuel chamber 9101 containing the fuel A and a working medium chamber 9102 containing the working medium B by an dividing element 911, the dividing element 911 can freely deform or move between the fuel chamber 9101 and the working medium chamber 9102 by pressure effect so as to transfer pressure from the working medium chamber 9102 to the fuel chamber 9101. It is worth mentioning that the number of working component 91 can also be an even number which is larger than two.

The fuel chamber 9101 is connected in parallel with an input one-way valve 10 and an output one-way valve 11, wherein the input one-way valve 10 is connected with an inlet of the fuel chamber 91011, the output one-way valve 11 is connected with an outlet of the fuel chamber 91012. The working medium chamber 9102 is connected with an outlet of the reversing component 81 via a gangway of the working medium chamber 91021 and a working medium tube 12.

According to the preferred embodiment of the present invention, the dividing element 911 is a flexible film. A periphery of the flexible film is hermetically fixed on an inner wall of the working component 91, the flexible film is made of fluorine rubber in order to improve the anti-corrosion ability and anti-swelling ability. The dividing element 911 can also be other embodiments, such as a dividing piston, the dividing piston freely moves between the fuel chamber 9101 and the working medium chamber 9102 so as to transfer pressure.

The working medium B is a liquid at normal temperature and pressure, the liquid can be hydraulic oil, engine oil or diesel. According to the preferred embodiment of the present invention, the working medium B is engine oil, the working medium case 7 is an oil sump tank of engine.

The reversing component 8 is a two-position four-way solenoid valve controlled by the electronic control unit 5, wherein a pressure inlet of the two-position four-way solenoid valve 82 is connected with an outlet of the high-pressure pump 61, a liquid returning vent of the two-position four-way solenoid valve 83 is connected with the working medium case 7. One two-position four-way solenoid valve can control two working components 91, the number of the two-position four-way solenoid valve increases in proportion when the number of working component is more than two. The two-position four-way solenoid valve can also be replaced by other component, such as one combination of four electromagnetic on-off valves substitutes for one two-position four-way solenoid valve.

According to the preferred embodiment of the present invention, an relief valve 13 is connected between the outlet of the high-pressure pump 61 and the pressure inlet of the reversing component 82, wherein the relief valve 13 is controlled by the electronic control unit 5, a liquid returning vent of the relief valve 131 is connected with the working medium case 7.

In order to further improve control precision of common rail pressure, a pressure sensor 14 is disposed on the common rail tube 2 for measuring fuel pressure within the common rail tube 2, wherein a signal output of the pressure sensor 14 is connected with the electronic control unit 5. The pressure sensor 14 can also be disposed on the pipeline between the high-pressure pump 6 and the two-position four-way solenoid valve because an output pressure of the high-pressure pump 6 and the fuel pressure within the common rail tube 2 are essentially equal. When the system demand is not high, the relief valve 13 can be replaced by a constant-pressure valve, and the pressure sensor 14 is cancelled, such that the output pressure of the high-pressure pump 6 is constant.

The fuel chamber 9101 is connected in parallel with an input one-way valve 10 and an output one-way valve 11. The input one-way valve 10 is connected with the fuel container 1 through an input main tube 15. On the input main tube 15, a manual shutoff valve 16 is in turn with a first electronic control shutoff valve 17 controlled by the electronic control unit 5, the manual shutoff valve 16 is closed when the engine does not work for a long time, the first electronic control shutoff valve 17 is closed when the engine meets emergency, such as leakage. The output one-way valve 11 is connected with the common rail tube 2 through an output main tube 18.

An electronic control one-way valve 19 is disposed between the common rail tube 2 and the output main tube 18, and is controlled by the electronic control unit 5. When the electronic control one-way valve 19 is power-on, the electronic control one-way valve 19 is two-way through; when the electronic control one-way valve 19 is power-off, the electronic control one-way valve 19 is one-way through, namely, the liquid or gas in common rail tube 2 can pass through the electronic control one-way valve 19, while the opposite way is blocked.

A second electronic control shutoff valve 20 is disposed between an input tube of DME and an output tube of DME, and is controlled by the electronic control unit 5, wherein one end of the second electronic control shutoff valve is disposed on the output main tube 18 located between the pressure convertor 9 and the electronic control one-way valve 19, another end of the second electronic control shutoff valve is disposed on the input main tube 15 located between the pressure convertor 9 and the fuel container 1. When the engine stops, the second electronic control shutoff valve 20 is open, the DME pressure within the common rail tube 2 is released and reduced to close to the pressure within the fuel container 1 so as to reduce the leakage between the electronic control injector 4 and the engine, and improve the system security.

The common rail electronic control injection system works as follows.

The generation and control of fuel pressure: the engine drives the high-pressure pump 6 to rotate when the engine works, the engine lubricant is inhaled into the high-pressure pump 6 from the working medium case 7, and comes out of the outlet of the high-pressure pump 61 after being pressed, the electronic control unit 5 uses the relief valve 13 to adjust the output pressure of the high-pressure pump 6, and the engine lubricant comes into the pressure inlet of the two-position four-way solenoid valve 82; the two-position four-way solenoid valve has two outlets, one outlet of the two-position four-way solenoid valve is communicated with the pressure inlet 82 so as to output the high-pressure lubricant into the working medium chamber 9102, and another outlet of two-position four-way solenoid valve is communicated with the liquid returning vent 83 so as to recycle the lubricant from the working medium chamber 9102; the high-pressure lubricant within the working medium chamber 9102 presses the fuel A within the fuel chamber 9101 spaced by the dividing element 911, here, the input one-way valve 10 is closed and the output one-way valve 11 is open, the fuel A is transferred into the common rail tube 2 by pipeline after being pressed, at the same time, in another working component 91, the low-pressure fuel A from the fuel container 1 comes into the fuel chamber 9101 and drives the lubricant to come out of the working medium chamber 9102 spaced by the dividing element 911, the lubricant returns into the working medium case 7 through the two-position four-way solenoid valve, then the inhaling process of the fuel A and the ejecting process of the working medium B have finished; the two-position four-way solenoid valve is controlled by the electronic control unit 5, periodically switches the working medium flow of the two outputs, such that two working components 91 alternately finish the ejecting and inhaling process of the fuel A.

In the above process, the pressure control of the fuel A within the common rail tube 2 depends on controlling the lubricant pressure, the pressure sensor 14 disposed on the common rail tube 2 sends the common rail pressure signal to the electronic control unit 5 so as to realize closed loop control of common rail pressure. In this process, the electronic control one-way valve 19 is in a two-way through condition, the first electronic control shutoff valve 17 is open, and the second electronic control shutoff valve 20 is closed.

The injection of the DME: the electronic control unit 5 judges the operation condition of the engine according to all input signals of the engine, gets different injection phase and injection amount, and controls the electronic control injector 4 to inject or not by the drive signal.

Stopping: after the engine stops, the first electronic control shutoff valve 17 is closed, the second electronic control shutoff valve 20 is open, the electronic control one-way valve 19 is in a one-way through condition, the high-pressure fuel A within the common rail tube 2 returns into the fuel container 1 through the electronic control one-way valve 19 and the second electronic control shutoff valve 20, the common rail pressure quickly depresses to be close to the pressure of the fuel container 1, here, because the temperature around the engine is high, the DME within the electronic control injector 4 and common rail tube 2 gasifies, the DME continually drains through the electronic control one-way valve 19 until there in no liquid fuel between the common rail tube 2 and the electronic control injector 4; the electronic control one-way valve 19 automatically closes to avoid the fuel regorging.

Emergency: in normal condition, the first electronic control shutoff valve 17 is open, the first electronic control shutoff valve 17 can be closed by the electronic control unit 5 or the driver when the system is found abnormal condition.

It is worth mentioning that the invention can be extended to other low-viscosity fuel similar with DME, such as injection system of liquefied petroleum gas.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An electronic control common rail DME injection system, comprising:

a fuel container containing a fuel, a common rail tube, a high-pressure pump, a high-pressure tube, an electronic control injector, an electronic control unit, a working medium case containing a working medium, a reversing component for reversing transport direction of the working medium, and a pressure convertor transferring working medium pressure to the fuel;

wherein said electronic control injector is communicated with said common rail tube through said high-pressure tube;

said working medium case is communicated with said common rail tube, said high-pressure pump, said reversing component and said pressure convertor connect in turn by pipeline;

an inlet of said pressure convertor is connected with the fuel within said fuel container, an outlet of said pressure convertor is connected with said common rail tube;

said pressure convertor comprises at least two parallel working components, wherein each working component is divided into a fuel chamber and a working medium chamber by a dividing element, said dividing element freely deforms or moves between said fuel chamber and said working medium chamber by pressure effect;

said fuel chamber is connected in parallel with an input one-way valve and an output one-way valve, said input one-way valve is connected with an inlet of said fuel chamber, said output one-way valve is connected with an outlet of said fuel chamber;

said fuel chamber is filled with the fuel;

said working medium chamber is connected with an outlet of said reversing component through a gangway of said working medium chamber and a working medium tube; said working medium chamber is filled with liquid working medium;

said reversing component is a two-position four-way solenoid valve controlled by said electronic control unit, wherein a pressure inlet of said two-position four-way solenoid valve is connected with an outlet of said high-pressure pump, and a liquid returning vent of said two-position four-way solenoid valve is connected with said working medium case;

a relief valve disposed between said outlet of said high-pressure pump and said pressure inlet of said two-position four-way solenoid valve, wherein said relief valve is controlled by said electronic control unit, a liquid returning vent of said relief valve is connected with said working medium case;

an electronic control one-way valve controlled by said electronic control unit is connected between said common rail tube and an output main tube, when said electronic control one-way valve is power-on, said electronic control one-way valve is two-way through; when said electronic control one-way valve is power-off, said electronic control one-way valve is one-way through, namely, said liquid or gas in said common rail tube is capable of passing through said electronic control one-way valve, while an opposite way is blocked;

an input main tube is located between said pressure convertor and said fuel container, a manual shutoff valve is connected in series with a first electronic control shutoff valve controlled by said electronic control unit; and a second electronic control shutoff valve is controlled by said electronic control unit, wherein one end of said second electronic control shutoff valve is disposed on said output main tube located between said pressure convertor and said electronic control one-way valve, another end of said second electronic control shutoff valve is disposed on said input main tube located between said pressure convertor and said fuel container.

2. The electronic control common rail DME injection system, as recited in claim 1, wherein said liquid working medium is one member selected from the group consisting of diesel oil, engine lubricant and hydraulic oil.

3. The electronic control common rail DME injection system, as recited in claim 1, wherein said dividing element is a flexible film, a periphery of said flexible film is hermetically fixed on an inner wall of said working component.

4. The electronic control common rail DME injection system, as recited in claim 2, wherein said dividing element is a flexible film, a periphery of said flexible film is hermetically fixed on an inner wall of said working component.

5. The electronic control common rail DME injection system, as recited in claim 3, wherein said flexible film is made of fluorine rubber.

6. The electronic control common rail DME injection system, as recited in claim 4, wherein said flexible film is made of fluorine rubber.

7. The electronic control common rail DME injection system, as recited in claim 1, wherein said dividing element is a dividing piston which freely moves between said fuel chamber and said working medium chamber.

8. The electronic control common rail DME injection system, as recited in claim 2, wherein said dividing element is a dividing piston which freely moves between said fuel chamber and said working medium chamber.

9. The electronic control common rail DME injection system, as recited in claim 1, wherein a pressure sensor is disposed on said common rail tube for measuring fuel pressure within said common rail tube, wherein a signal output of said pressure sensor communicates with said electronic control unit.

10. The electronic control common rail DME injection system, as recited in claim 2, wherein a pressure sensor is disposed on said common rail tube for measuring fuel pressure within said common rail tube, wherein a signal output of said pressure sensor communicates with said electronic control unit.

11. The electronic control common rail DME injection system, as recited in claim 3, wherein a pressure sensor is disposed on said common rail tube for measuring fuel pressure within said common rail tube, wherein a signal output of said pressure sensor communicates with said electronic control unit.

12. The electronic control common rail DME injection system, as recited in claim 4, wherein a pressure sensor is disposed on said common rail tube for measuring fuel pressure within said common rail tube, wherein a signal output of said pressure sensor communicates with said electronic control unit.

13. The electronic control common rail DME injection system, as recited in claim 5, wherein a pressure sensor is disposed on said common rail tube for measuring fuel pressure within said common rail tube, wherein a signal output of said pressure sensor communicates with said electronic control unit.

14. The electronic control common rail DME injection system, as recited in claim 6, wherein a pressure sensor is disposed on said common rail tube for measuring fuel pressure within said common rail tube, wherein a signal output of said pressure sensor communicates with said electronic control unit.

15. The electronic control common rail DME injection system, as recited in claim 7, wherein a pressure sensor is disposed on said common rail tube for measuring fuel pressure within said common rail tube, wherein a signal output of said pressure sensor communicates with said electronic control unit.

16. The electronic control common rail DME injection system, as recited in claim 8, wherein a pressure sensor is disposed on said common rail tube for measuring fuel pressure within said common rail tube, wherein a signal output of said pressure sensor communicates with said electronic control unit.

17. The electronic control common rail DME injection system, as recited in claim 1, wherein a pressure sensor is disposed on a pipeline between said high-pressure pump and said two-position four-way solenoid valve.

18. The electronic control common rail DME injection system, as recited in claim 3, wherein a pressure sensor is disposed on a pipeline between said high-pressure pump and said two-position four-way solenoid valve.

19. The electronic control common rail DME injection system, as recited in claim 4, wherein a pressure sensor is disposed on a pipeline between said high-pressure pump and said two-position four-way solenoid valve.

20. The electronic control common rail DME injection system, as recited in claim 7, wherein a pressure sensor is disposed on a pipeline between said high-pressure pump and said two-position four-way solenoid valve.

* * * * *